United States Patent [19]

Fasterding et al.

[11] Patent Number: 4,756,476

[45] Date of Patent: Jul. 12, 1988

[54] RAILWAY SWITCH

[75] Inventors: Günter Fasterding, Ilsede; Jürgen Frenzel, Freden; Norbert Jacoby; Bernd-Joachim Kempa, both of Berlin, all of Fed. Rep. of Germany

[73] Assignee: Stahlwerke Peine-Salzgitter AG, Salzgitter, Fed. Rep. of Germany

[21] Appl. No.: 904,176

[22] Filed: Sep. 5, 1986

[30] Foreign Application Priority Data

Sep. 6, 1985 [DE] Fed. Rep. of Germany ..... 3531855

[51] Int. Cl.[4] ..... E01B 7/22

[52] U.S. Cl. ..... 238/44; 238/27; 246/454

[58] Field of Search ..... 238/44, 28, 27, 65; 246/415 R, 454

[56] References Cited

U.S. PATENT DOCUMENTS

| | | | |
|---|---|---|---|
| 524,999 | 8/1894 | Benjamin | 238/44 |
| 838,573 | 12/1906 | O'Connor | 238/28 |
| 946,760 | 1/1910 | Leahy | 238/44 |
| 2,815,185 | 12/1957 | Hirtenstein | 246/254 |
| 4,285,115 | 8/1981 | Frenzel | 29/460 |

FOREIGN PATENT DOCUMENTS

| | | | |
|---|---|---|---|
| 2649830 | 9/1977 | Fed. Rep. of Germany | 246/415 R |
| 1967 | 8/1849 | France | 238/27 |
| 81116 | 10/1945 | Luxembourg . | |

*Primary Examiner*—Robert B. Reeves
*Assistant Examiner*—Donald T. Hajec
*Attorney, Agent, or Firm*—Nils H. Ljungman

[57] ABSTRACT

A railway switch is mounted on y-shaped sleepers. All sleepers in the switch have a medium portion of equal slightly s-shaped configuration and length. The length of the straight and parallel ends depends on the position of the individual sleeper in the switch. The sleepers extend alternately from one outer rail in the direction to the other outer rail. The crossing piece is supported by y-shaped sleepers which underlie only the crossing piece and alternately one of the outer rails in the switch. If the switch comprises a straight and a curved line, all sleepers supporting the outer straight rail are arranged at a right angle to the straight line and protrude outwardly over the straight rail in the same length. Preferably the sleepers are composed of two s-shaped I-beam steel profiles and additional shorter I-beam steel profiles at the bifurcated straight ends, all pairs of adjacent I-beams being connected at a distance forming a slit for inserting a coach screw.

19 Claims, 5 Drawing Sheets

RAILWAY SWITCH

BACKGROUND OF THE INVENTION

The invention relates to a railway switch such as for usual and high-speed railways and for urban and works railways. More particularly, the invention relates to the sleepers underlying the rails and the crossing piece of a switch. Switches or points for railways with different arrangement of the lines and the rails are well-known. Usually the sleepers of the switches are straight parts of wood, concrete or steel and are arranged at right angle to the center line of the crossing. The ends of the sleepers protrude over the outer rails so that very long sleepers are required for a switch. Long sleepers are usually necessary to compensate the side force at the beginning or the end of the curved line in the switch. The crossing piece has to bear a greater load than other parts of the rails. This results in deforming the sleepers underlying the crossing piece or in lowering the roadbed or the ballast, and requires, after some time, a replacing of the sleepers supporting the outer rails and the crossing, or to pack the ballast new, or to apply compensating plates. Such repair is difficult under the crossing piece, particularly in case of using long sleepers. Unsufficient supported crossing pieces show strong wear.

DESCRIPTION OF PRIOR ART

In the U.S. Pat. No. 4,285,115 (granted to Jürgen Frenzel, one of the present inventors) y-shaped sleepers are described for straight and curved lines. The end portions of the sleepers for underlying the rails are straight and parallel, the medium portions are diverging and curved. The sleepers may be made from I-beam steel profiles. At the one straight end the two I-beams are connected by welding. On the other ends the straight ends are doubled in that short I-beams are welded parallel to the straight ends.

A similar configuration of y-shaped steel sleepers is shown in the Luxembourg Pat. No. 81 116 (one of the inventors being the present inventor Jürgen Frenzel). The Patent is related to a system for fastening the rails on the sleepers. The system comprises clamping means and coach screws screwed in a block which is inserted in the space between the adjacent I-beam profiles.

As far as we know, it was not considered to apply y-shaped sleepers for switches up to now.

SUMMARY OF THE INVENTION

It is a subject of the invention to improve the arrangement of sleepers for switches so that e.g. mounting and rapair becomes easier, and that high loads and side forces can be transferred from the rails to the roadbed.

A railway switch, according to the invention, comprises spaced-apart parallel rails of lines which diverge from the point of the switch to the switch and, a crossing piece, and y-shaped sleepers supporting the rails and the crossing piece. The y-shaped sleepers have straight end portions and diverging middle portions. The middle portions are of identical shape and length in the switch, whereas the length of the straight end portion of the sleepers is different depending on the position of the sleeper in the switch. The y-shaped sleepers are arranged in alternate order. The crossing piece is supported by y-shaped sleepers which mainly extend between one outer rail and the crossing piece but do not support the other outer rail.

The sleepers may be made from concrete or, preferably, from I-beam steel profiles. If steel profiles are used, the medium portion of all sleepers, which has a slight s-shape of identical form and length, can be formed in one bending machine independent from the total length of the individual sleeper or I-beam.

In a preferred embodiment the sleepers are arranged in alternate direction, and the crossing piece is supported by the basic end portions of some y-shaped sleepers, the bifurcated other end portions of which support outer rails.

If the switch comprises a straight and a curved line it is preferred to arrange the sleepers at right angle to the straight line and to have the straight end portions protruding outwardly over the outer rail of the straight line to the same extend.

Furthermore, it is preferred to arrange the straight end portions of the I-beams so that there is a small distance between directly neighbouring parts of a sleeper, which are connected by bars running about parallel to the rails. The small distance forms a slit through which coach screws may be screwed in a block slideably inserted between the I-beams. The bars may be welded to the upper side of the I-beams in a position in which they sidewardly secure means supporting the rails on the sleeper.

BRIEF DESCRIPTION OF THE DRAWINGS

The drawings show diagrammatic views of a left-hand railway switch and of parts thereof.

DESCRIPTION OF A PREFERRED EMBODIMENT

Figure 1A:
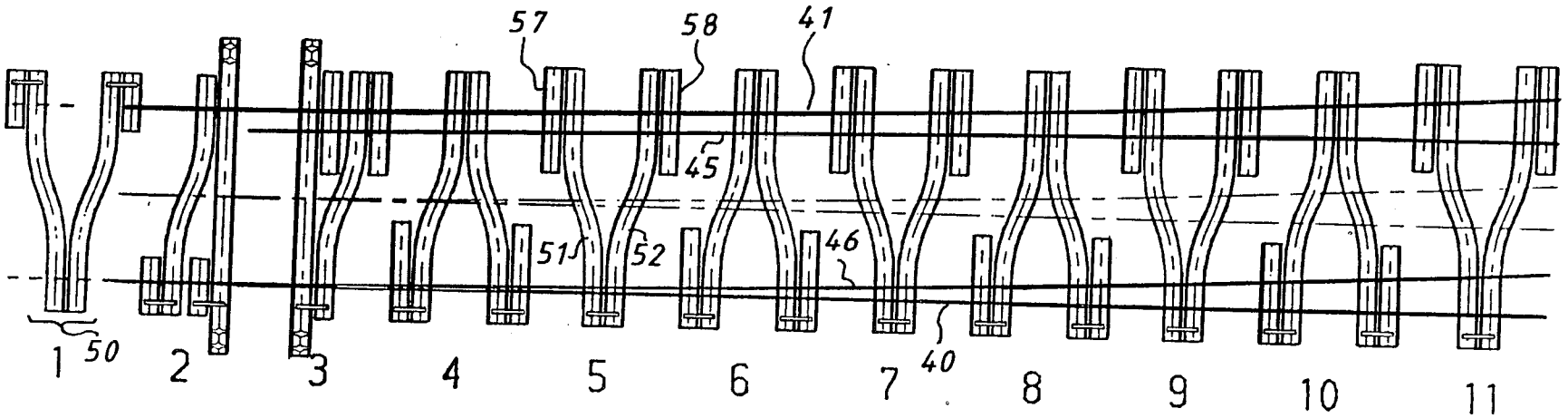
FIGS. 1*a*, 1*b*, and 1*c* show subsequent regions of a switch. The rails and the crossing piece are mounted on y-shaped sleepers of I-beam steel profiles.
Figure 1B:
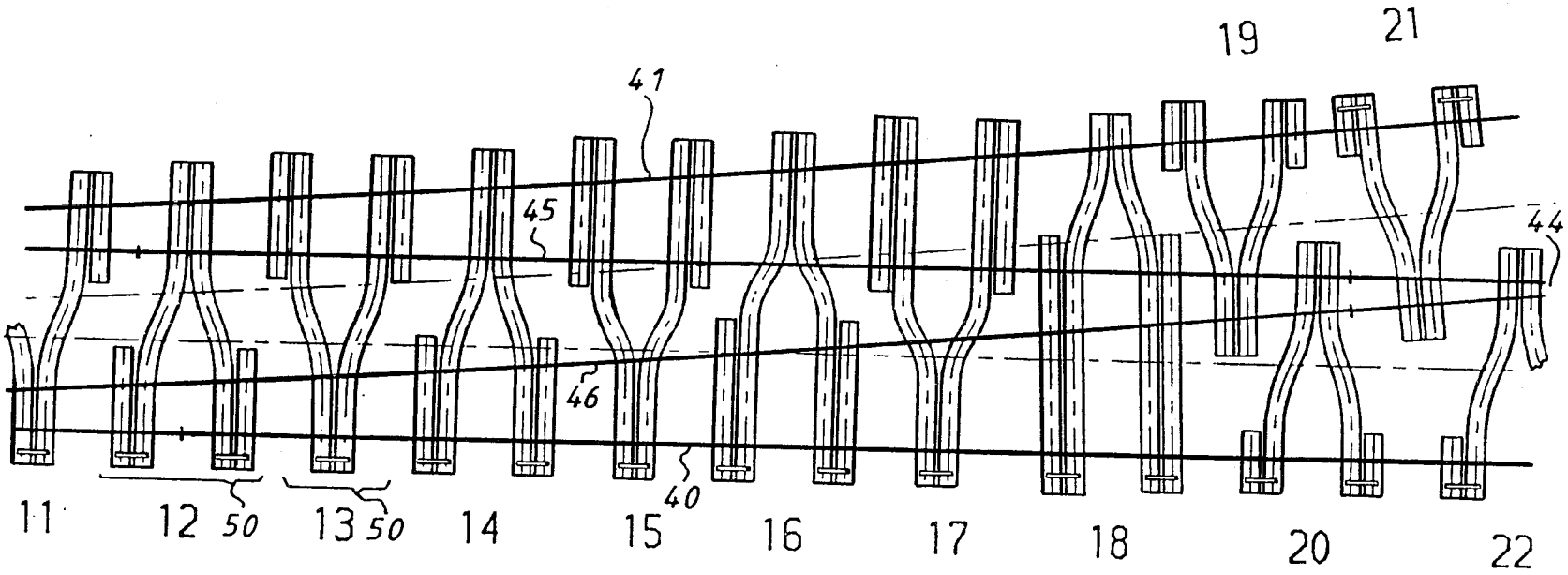
Figure 1C:
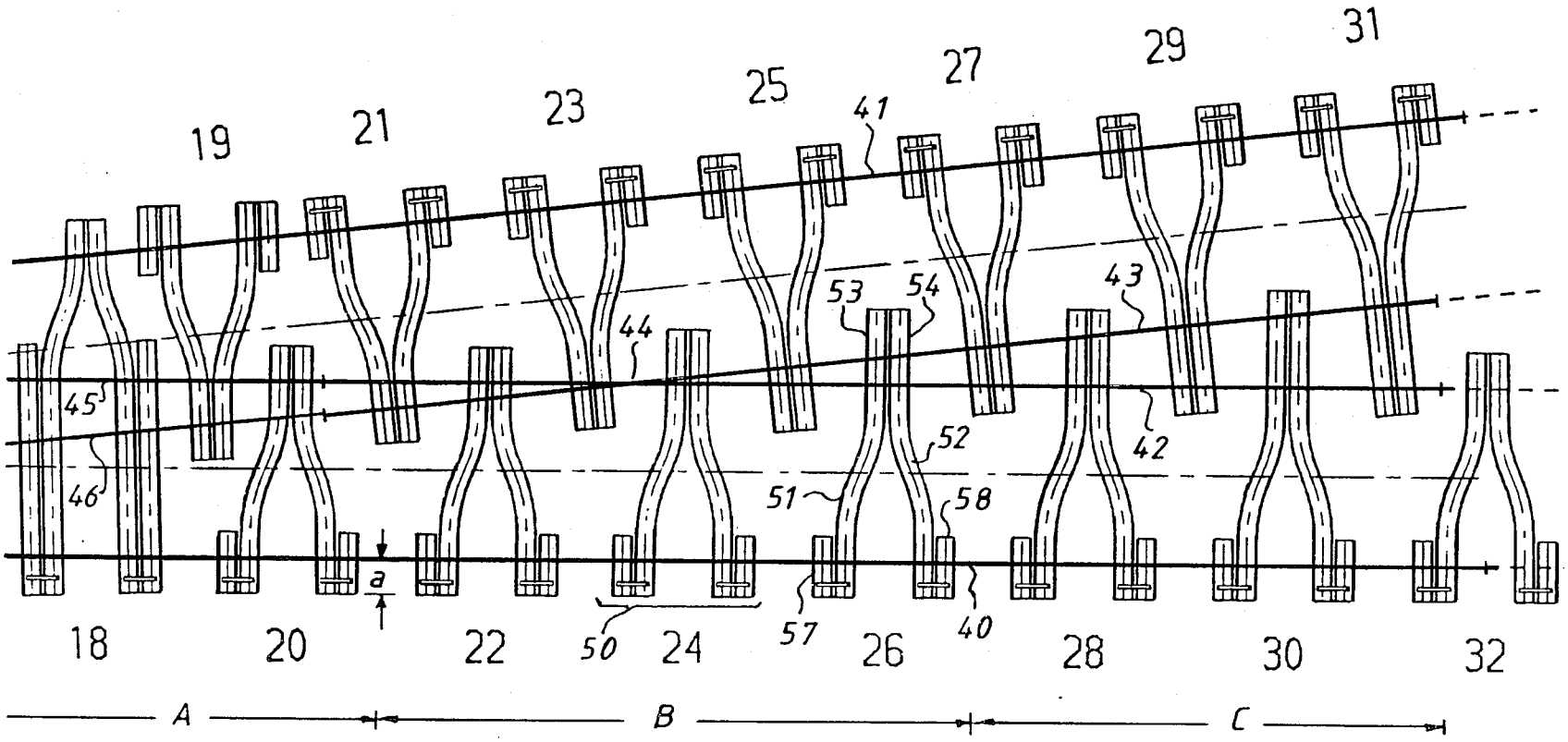

In FIGS. 1*a*, 1*b*, and 1*c* subsequent sleepers are numbered by 1 to 32. Sleeper 1 is still outside the point of the switch and sleeper 32 supports partly the straight line of the switch and partly the line conected to the switch end. In FIG. 1*c* A defines the region of the tongue, which is here not shown in full length, B is about the region of the crossing piece, and C is the region of the separately diverging tracks consecutive to the crossing piece.

The parts of the spaced-apart rails and the crossing piece may be of any usual embodiment and are therefore shown only schematically as simple lines. The outer rail of the straight line of the switch is numbered 40, the outer rail of the curved line is 41. 42 and 43 are the inner rails of the straight and the curved lines. The inner rails commence from the crossing piece or frog 44. The tongues of the switch are 45 and 46. They are moved by a device (not shown) for throwing over the points, which device may be placed between sleepers 2 and 3 and laterally thereof. With the exception of sleepers 2 and 3, all sleepers 4 to 32 are y-shaped having an identically bent medium part of the I-beam steel profiles in form of a slight s-shape. The length of the rectilinear ends of the sleepers is different depending on the place of the sleeper in the switch. However, it is possible to use sleepers of the same total length on several places. Sleepers 1, 4, and 19 to 23 are of identical configuration and length. Sleepers 4 to 18 are arranged alternately and laterally reversed. The sleepers comprise I-beams 51 and 52 connected at the basic straight end portions 53, 54 of the y-shape, and short I-beam parts 57 and 58 running parallel to the bifurcated straight end portions 55, 56. I-beams 51, 52, 57, and 58 of sleepers 3 to 20 may support the movable tongues 45 and 46.

Sleepers 19 to 32 are arranged in that way that the bifurcated ends of each are placed under one of the outer rails 40 to 41, and the connected straight basic end portions 53, 54 underlie the inner rails 42, 43 and particularly the crossing piece 44. Hereby the crossing piece 44 is resiliently supported which is advantageous, and permits to pack the ballast under the crossing piece with usual packing machines, which is not possible with normal straight sleepers extending from one outer rail under the crossing piece to the outer outer rail. A resilient support of a crossing piece which is sufficiently sustained by sleepers and ballast or the roadbed direct under the sleepers, reduces wear of the crossing piece and results in a safe guiding of the wheels of a train.

Y-shaped sleepers provide for a high resistance against side-forces which may occur if a train runs over the curved line of the switch. Therefore the length of the sleepers according to the invention may be smaller than with common straight sleepers, and the sleepers can be dimensioned for high-speed railways as well as for a narrow radius of a switch curve such as in industrial and urban railways, which often have to be layed on narrow embankments.

Figure 2:
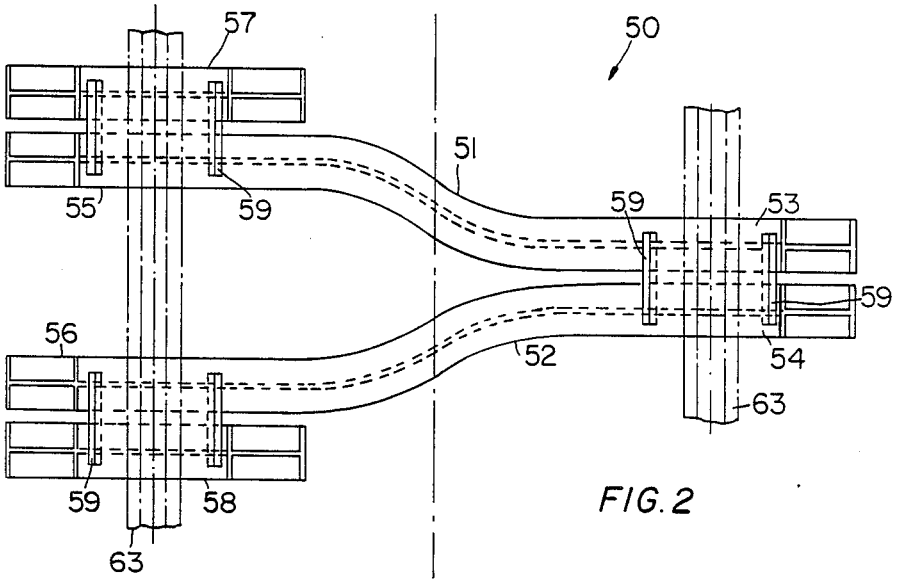
FIG. 2 is a plan view of a y-shaped sleeper
Figure 3:
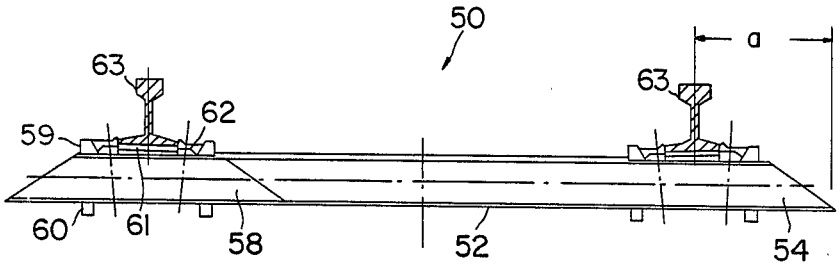
FIG. 3 is a view of the sleeper seen in the direction of the rails
Figure 5:
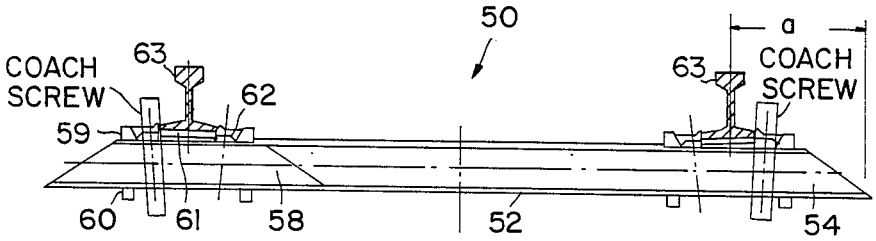
FIG. 5 is similar to FIG. 3, but shows the location of the means for fastening the rails, e.g., a coach screw.
Figure 4:
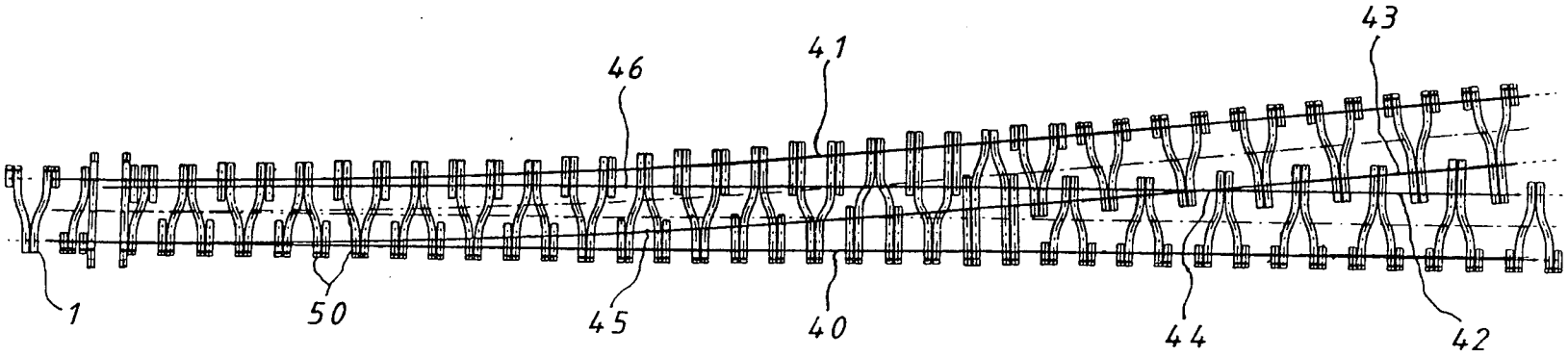
FIG. 4 is a view in reduced scale of the whole switch, the regions of which are shown in FIGS. 1*a*, 1*b*, and 1*c*.

FIGS. 2 and 3 show a y-shaped sleeper made from two I-beam steel profiles 51, 52, which are curved as a slender S in opposite direction. The ends of the I-beam profiles are rectilinear and positioned in parallel directions. Adjacent to the bifurcated ends 55 and 56 shorter I-beam steel profiles are arranged so that at all straight ends pairs of I-beams are present. The side-by-side with a certain distance placed straight parts 53, 54 and 55, 57, and 56, 58 are connected by bars 59, 60 running parallel to the rails 63. Bars 59 are welded to the upper side of the I-beams. The distance between two adjacent I-beams forms a slit for inserting a coach screw (not shown in the drawings). The coach screws are screwed in a block (not shown) or similar prefabricated fastening part made from steel or hard plastics and placed in the space between the adjacent I-beams. On the portion of the I-beams supporting the rails and between the upper bars 59 one or more liners 61 or tie-plates, preferably of resilient and electrically insulating material, and on both sides of the base of the rail lateral guiding parts 62 are placed. Contacting sides of the bars 59 and the lateral parts 62 may be wedge-shaped. Also the guiding parts 62 are made of electrically insulating materials. Clamp clips (not shown) are pressed vertically by the coach screws against the base of the rail 63 and the lateral parts 62. The part of the coach screw that presses the clamping means downwards is provided with an insulating sleeve. Herewith the rails are electrically protected from direct contact with the sleepers and the ground.

All sleepers of the straight line extend outwards over the outer rail 40 to an identical rate illustrated by "a" in FIG. 1*c*, and all sleepers of the straight line are positioned at right angle to the rail 40. Hereby, the sleepers are exactly to be aligned when the switch is prefabricated in a workshop and when it is mounted at its place of destination, and all parts of a point for supporting a rail can at least for the straight rail be composed before the switch is mounted the first time.

The preceeding description relates particularly to a normal simple switch or turn-off, but the invention may also be applied for double-curve switches, for mixed gauge switches, for crossing of lines and slip points.

What is claimed is:

1. A railway switch for being disposed on ballast and for switching railway trains in a railway system, comprising:

a first railway track comprising a first outer rail and a first inner rail;

a second railway track diverging from said first railway track, said second railway track comprising a second outer rail and a second inner rail;

a crossing region proximate a location wherein said first and second inner rails cross; and a plurality of Y-shaped sleepers supporting said first and second railway tracks in at least said crossing region, each of said Y-shaped sleepers having a branched end and a stem end;

a first number of said plurality of Y-shaped sleepers being disposed such that said branched ends thereof support said first outer rail and said stem ends thereof support said first and second inner rails; and a second number of said plurality of Y-shaped sleepers being disposed such that said branched ends thereof support said second outer rail and said stem ends thereof support said first and second inner rails.

2. The railway switch according to claim 1, wherein said Y-shaped sleepers supporting said first and second railway tracks in at least said crossing region are alternately one of said first number and one of said second number.

3. The railway switch according to claim 2, wherein said first railway track is substantially straight and said second railway track is substantially curved and wherein substantially all of said branched ends of said first number of Y-shaped sleepers supporting said first outer rail are disposed substantially at right angles to said first outer rail and extend beyond said first outer rail by a substantially equal length.

4. The railway switch according to claim 3, wherein, in at least said crossing region, said branched ends of said plurality of Y-shaped sleepers are of substantially similar configuration and length and the lengths of said stem ends of said Y-shaped sleepers vary according to their position along the railway.

5. The railway switch according to claim 3, further comprising entry and exit regions located at opposed ends of said crossing region and additional first and second numbers of said Y-shaped sleepers supporting said first and second railways in said entry and exit regions.

6. The railway switch according to claim 3, wherein at least one of said Y-shaped sleepers comprises:

two first I-beam steel members, each having a central portion with a similar S-shaped curvature and first and second substantially straight end portions;

said two first I-beam steel members being configured so as to form said Y-shaped sleeper, said stem portion of said Y-shaped sleeper comprising said first substantially straight end portions spaced apart to form a slit adapted to accept a coach screw;

two additional I-beam steel members disposed adjacent said second substantially straight end portions of said first I-beam steel members and spaced therefrom to form slits adapted to accept coach screws; and means for interconnecting said first end portions of said first two I-beam steel members and for maintaining said spatial interrelationship thereof and for interconnecting said two additional I-beam steel members to said second end portions of said first I-beam steel members and for maintaining said spatial interrelationship thereof.

7. The railway switch according to claim 2, wherein, in at least said crossing region, said branched ends of said plurality of Y-shaped sleepers are of substantially similar configuration and length and the lengths of said stem ends of said Y-shaped sleepers vary according to their position along the railway.

8. The railway switch according to claim 7, further comprising entry and exit regions located at opposed ends of said crossing region and additional first and second numbers of said Y-shaped sleepers supporting said first and second railways in said entry and exit regions.

9. The railway switch according to claim 2, further comprising entry and exit regions located at opposed ends of said crossing region and additional first and second numbers of said Y-shaped sleepers supporting said first and second railways in said entry and exit regions.

10. The railway switch according to claim 2, wherein at least one of said Y-shaped sleepers comprises:

two first I-beam steel members, each having a central portion with a similar S-shaped curvature and first and second substantially straight end portions;

said two first I-beam steel members being configured so as to form said Y-shaped sleeper, said stem portion of said Y-shaped sleeper comprising said first substantially straight end portions spaced apart to form a slit adapted to accept a coach screw;

two additional I-beam steel members disposed adjacent said second substantially straight end portions of said first I-beam steel members and spaced therefrom to form slits adapted to accept coach screws; and means for interconnecting said first end portions of said first two I-beam steel members and for maintaining said spatial interrelationship thereof and for interconnecting said two additional I-beam steel members to said second end portions of said first I-beam steel members and for maintaining said spatial interrelationship thereof.

11. The railway switch according to claim 1, wherein said first railway track is substantially straight and said second railway track is substantially curved and wherein substantially all of said branched ends of said first number of Y-shaped sleepers supporting said first outer rail are disposed substantially at right angles to said first outer rail and extend beyond said first outer rail by a substantially equal length.

12. The railway switch according to claim 11, wherein, in at least said crossing region, said branched ends of said plurality of Y-shaped sleepers are of substantially similar configuration and length and the lengths of said stem ends of said Y-shaped sleepers vary according to their position along the railway.

13. The railway switch according to claim 11, further comprising entry and exit regions located at opposed ends of said crossing region and additional first and second numbers of said Y-shaped sleepers supporting said first and second railways in said entry and exit regions.

14. The railway switch according to claim 11, wherein at least one of said Y-shaped sleepers comprises:

two first I-beam steel members, each having a central portion with a similar S-shaped curvature and first and second substantially straight end portions;

said two first I-beam steel members being configured so as to form said Y-shaped sleeper, said stem portion of said Y-shaped sleeper comprising said first substantially straight end portions spaced apart to form a slit adapted to accept a coach screw;

two additional I-beam steel members disposed adjacent said second substantially straight end portions of said first I-beam steel members and spaced therefrom to form slits adapted to accept coach screws; and means for interconnecting said first end portions of said first two I-beam steel members and for maintaining said spatial interrelationship thereof and for interconnecting said two additional I-beam steel members to said second end portions of said first I-beam steel members and for maintaining said spatial interrelationship thereof.

15. The railway switch according to claim 1, wherein, in at least said crossing region, said branched ends of said plurality of Y-shaped sleepers are of substantially similar configuration and length and the lengths of said stem ends of said Y-shaped sleepers vary according to their position along the railway.

16. The railway switch according to claim 15, further comprising entry and exit regions located at opposed ends of said crossing region and additional first and second numbers of said Y-shaped sleepers supporting said first and second railways in said entry and exit regions.

17. The railway switch according to claim 15, wherein at least one of said Y-shaped sleepers comprises:

two first I-beam steel members, each having a central portion with a similar S-shaped curvature and first and second substantially straight end portions;

said two first I-beam steel members being configured so as to form said Y-shaped sleeper, said stem portion of said Y-shaped sleeper comprising said first substantially straight end portions spaced apart to form a slit adapted to accept a coach screw;

two additional I-beam steel members disposed adjacent said second substantially straight end portions of said first I-beam steel members and spaced therefrom to form slits adapted to accept coach screws; and means for interconnecting said first end portions of said first two I-beam steel members and for maintaining said spatial interrelationship thereof and for interconnecting said two additional I-beam steel members to said second end portions of said first I-beam steel members and for maintaining said spatial interrelationship thereof.

18. The railway switch according to claim 1, further comprising entry and exit regions located at opposed ends of said crossing regions and additional first and second numbers of said Y-shaped sleepers supporting said first and second railways in said entry and exit regions.

19. The railway switch according to claim 1, wherein at least one of said Y-shaped sleepers comprises:

two first I-beam steel members, each having a central portion with a similar S-shaped curvature and first and second substantially straight end poritons;

said two first I-beam steel members being configured so as to form said Y-shaped sleeper, said stem portion of said Y-shaped sleeper comprising said first substantially straight end portions spaced apart to form a slit adapted to accept a coach screw;

two additional I-beam steel members disposed adjacent said second substantially straight end portions of said first I-beam steel members and spaced therefrom to form slits adapted to accept coach screws; and means for interconnecting said first end portions of said first two I-beam steel members and for maintaining said spatial interrelationship thereof and for interconnecting said two additional I-beam steel members to said second end portions of said first I-beam steel members and for maintaining said spatial interrelationship thereof.

* * * * *